United States Patent [19]

Kuge et al.

[11] 4,185,129

[45] Jan. 22, 1980

[54] METHOD FOR DEVELOPING ELECTROSTATIC LATENT IMAGES AND REMOVAL OF EXCESS DEVELOPER

[75] Inventors: Tsukasa Kuge, Tokyo; Toru Matsumoto, Kita; Tsuyoshi Watanabe; Yasuyuki Tamura, both of Kawasaki, all of Japan

[73] Assignee: Canon Kabushiki Kaisha, Tokyo, Japan

[21] Appl. No.: 871,710

[22] Filed: Jan. 23, 1978

[30] Foreign Application Priority Data

Jan. 28, 1977 [JP] Japan ..... 52/8320

[51] Int. Cl.[2] ..... G03G 13/10; G03G 13/08; G03G 13/22

[52] U.S. Cl. ..... 430/120; 430/120; 430/97; 134/36

[58] Field of Search ..... 96/1 LY, 1.3, 1 SD; 252/62.1 L; 134/36; 427/16, 17

[56] References Cited

U.S. PATENT DOCUMENTS 3,703,400 11/1972 Tamai et al. ..... 96/1 LY
3,849,171 11/1974 Takahashi et al. ..... 96/1 LY

*Primary Examiner*—John D. Welsh

*Attorney, Agent, or Firm*—Fitzpatrick, Cella, Harper & Scinto

[57] ABSTRACT

A method for developing electrostatic latent images comprises a first step of supplying uniformly a developer containing developing particles onto an electrostatic latent image carrying surface and a second step of supplying liquid onto the latent image carrying surface to remove any excess developer from the surface while leaving on the surface only such developing particles that are able to be retained as a result of the relative attraction between the developing particles and the electrostatic latent image so as to visualize the latent image. Apparatus for carrying out the method comprises a developing particle applying means and a liquid supplying means. The developing particle applying means is disposed to effect a uniform adhesion of developing particles onto an electrostatic latent image carrying surface. The liquid supplying means supplies a liquid onto the surface in such a manner that on the surface there remains only such developing particles that are able to be retained as a result of the relative attraction between the particles and the electrostatic latent image and all excess developing particles are removed from the surface.

11 Claims, 9 Drawing Figures

METHOD FOR DEVELOPING ELECTROSTATIC LATENT IMAGES AND REMOVAL OF EXCESS DEVELOPER

BACKGROUND OF THE INVENTION

1. Field of the Invention

The present invention relates to a method and apparatus for developing electrostatic latent images formed in electrophotographic process, electrostatic recording process and other similar process.

2. Description of the Prior Art

In the technical field of image-forming for electrophotography and electrostatic recording, there are known and used various methods to visualize, that is, develope the latent image electrically formed on a latent image carrier such as a so-called photosensitive medium made of photoconductive material, an electrostatic recording material and the like. According to these conventional methods, the latent images are visualized, i.e. developed by applying onto the latent image carrying surface electroscopic particles, that is, developing particles which are more or less selectively attracted or repulsed by the electrostatic charge of the latent image, although there is some difference in actual procedure depending upon whether is desired a direct reproduction or a reversal reproduction. The above-mentioned type of developing or electroscopic particle is generally called toner and well-known in the art. For a direct reproduction, the developing particles adhere to the area of the latent image. For a reversal reproduction, the developing particles adhere to the area out of the latent image.

As such developing method, hitherto there are widely known two types of developing method. One is a so-called dry developing method wherein a developer in a form of dry powder is used. The other is a wet developing method wherein a dispersion of developing particles in liquid is used.

For example, magneto-brush method as disclosed in U.S. Pat. No. 2,874,063, cascade method as disclosed in U.S. Pat. No. 2,618,552 and powder clouding method as disclosed in U.S. Pat. No. 2,221,776 are knwon as the representatives of dry developing method.

One typical wet developing method hitherto known is a method wherein the electrostatic latent image carrying surface is brought into contact with a so-called liquid developer containing developing particles dispersed in a dielectric liquid carrier having a volume resistance more than $10^{10}\Omega$ cm and a permittivity less than 3 (for example, paraffin hydrocarbons). When contacted, the developing particles, i.e. toner particles are adsorbed by an attraction force onto the electrostatic latent image on the image carrying surface and thereby development of the latent image is effected.

All of the known methods for developing electrostatic latent images are in common with each other in the fact that there are used such developing particles that are more or less selectively attracted or repulsed by the electrostatic charge of the latent image and their deposition effect is made use of to visualize the latent image.

However, these conventional developing methods which are based upon the deposition of the developing particles, have various problems and drwbacks in view of their practical use. For example, in order to efficiently effect depositing such developing particles, it is required to charge the particles with a sufficient electrostatic charge enough to allow the particles to deposit in a short time. Furthermore, in order to produce images uniform in quality, the individual particles have to be charged uniformly. These requirements of developing particles can be satisfied only by a high standard preparing technique and a high cost.

Another problem is found in that a suitable control of the density of developer and a uniform supply of the developer onto the latent image carrying surface are required to attain a uniform deposition with a stable density of the developing particles on the electrostatic latent image. To solve the problem it has been proposed in the art to supply the developer in a form of jet flow. But, this method has a particular drawback that it is very difficult to control the flow of the jet uniformly.

The above described problems involved in the conventional developing methods wil be intensified when developments should be carried out with a higher efficiency and in a shorter time. The deposition of developing particles in the wet developing process, i.e. liquid developing process is generally considered to be based on the phenomenon of electrophoresis of the electrically charged developing particles. In general, the migration speed of charged particles is intrinsically very slow. Therefore, for a speed-up of the development, it is absolutely necessary to increase the electric charge on the developing particles, to supply a greater amount of developing particles with a higher efficiency and also to intensify the electric field up to a sufficiently higher level.

However, preparation of such developing particles having a higher and uniform electric charge is extremely difficult to do. Moreover, in order to enable to supply the developer with a higher efficiency, a developer containing developing particles in higher concentration must be used while supplying it in a form of high speed jet flow or employing a high speed coating roller. But, when the concentration of developing particles in a developer is increased, there often occurs another problem called "fogging" phenomenon which makes the non-image portion dirty due to the undesirable adhesion of developing particles other than those deposited in the image portion by the electrostatic attraction. Therefore, the use of high concentration of developing particles is limited. To eliminate the problem of this "fogging" it is known and used to apply a bias, the polarity of which is opposite to that of the particles, to the conductive rollers or electrodes used in the developing station. But, since the electric field used for the deposition of developing particles is usually opposite to that used for the elimination of fogging, the use of this solution is restricted within limited cases as a matter of course.

It is true that an increase in efficiency of development may be attained by increasing the intensity of the electric field and by increasing accordingly the migration speed of the developing particles. However, it has also some severe limitations to make the electrode distance between the developing electrodes small as required for this purpose as well as to increase the potential of the latent images as required.

On the other hand, when the liquid developer is supplied with a high speed, the ununiformity of flow of the liquid developer will be enhanced thereby because of a rapid movement of the liquid containing developing particles dispersed therein. As a result, the developed images lack uniformity and sharpness. To produce developed images of good quality sufficient for practical use, it is absolutely necessary to precisely accomplish the uniformity of flow of the developer to be supplied.

In summary, all of the developing methods hitherto known necessitate a high standard of technique regarding the control of characteristics of developer and of its supply. Also, it is one of the important drawbacks of the known developing methods that there is a particular difficulty to eliminate the so-called marginal effect. Marginal effect is known as such a phenomenon that the portion of a developed image which should have one same density can not appear in the aimed same density but becomes more thicker at its marginal and more thinner at its center. Various methods are known and used to reduce the marginal effect. For example, it has been proposed to form the electrostatic latent image in a form of mesh points. Also, it is known to dispose a flat plate electrode in parallel with and very close to the surface of electrostatic latent image so that the development of the latent image may be carried out decreasing the intensity of electric field applied to the marginal portion of the electrostatic latent image. However, all the known methods were found to be unsatisfactory to eliminate the marginal effect completely.

For the sake of reference, here will be mentioned of prior arts apparently similar to the invention.

U.S. Pat. No. 2,297,691 specification discloses a developing method in which electroscopic particles (that is a so-called toner) are supplied to an electrostatic latent image carrying surface and any excess toner remaining on the produced image is removed out of the image carrying surface by blowing air (see, lines 27–44 in the right column on page 6, lines 12–17 at the right column on page 3 and FIGS. 3 and 4).

U.S. Pat. No. 3,276,896 specification discloses another developing method in which after developing of a latent image with a liquid developer, a liquid medium suspension containing substantially none of electroscopic developing particles is applied to the developed image so as to solve the problem of adhesion of developing particles on the non-image portion which makes the image dirty (see, lines 19–27 in column 5, lines 20–23 in column 2 and FIGS. 1 and 2).

The latter mentioned invention, namely the invention disclosed in U.S. Pat. No. 3,276,896 may be considered at a first glance to be similar to the present invention. However, there is a distinct difference therebetween. The primary object of the prior invention is to eliminate the problem of developed images being stained with excess developing particles, that is, the problem of fogging. To this end, the developing method according to the prior invention comprises two steps, namely a first step of developing an electrostatic latent image with electrically charged developing particles based upon the phenomenon of electrophoresis of the particles and a second step of cleaning off such developing particles unnecessarily adhered to the non-image portion. In contrast with the prior invention, the object of the present invention is to provide a developing method which enables to carry out a liquid development, in particular, at a higher speed. According to the present invention, the supply of developing particles to an electrostatic latent image carrying surface at its first step of the method is carried out not to have the particles deposit based on the electrophoresis of the particles relative to the electrostatic latent image but to have the particles adhere to the image carrying surface mainly depending upon the cohesive force between the particles and the inter-molecular force between the particle and the image carrying surface, independently of the electrostatic latent image. The visualization, i.e. development of the electrostatic latent image takes place at its second step of the method only when a liquid is supplied to the developing particles on the image carrying surface. According to the method of the present invention, the problem of the known developing methods caused by the fact that the known methods are based on the electrophoresis action of the electrically charged particles, can be substantially eliminated.

As will be understood from the foregoing, there is a fundamental difference in object as well as in effect of invention between the above mentioned prior invention and the present invention. Therefore, the present invention is entirely novel to the prior art.

An apparent similarity of the developing methods and apparatus of the prior art to the present invention is attributable to the fact that the former also has a first step of supplying electroscopic particles and a second step of removing excess developing particles. However, in all the known methods as particularly described above, the visualization, i.e. development of the latent image primarily takes place at the first step, namely at the time when the toner is supplied. On the contrary, in the method of the present invention, the development of the latent image mainly takes place at the second step where a liquid is supplied. In view of these points, the present invention differs from the prior art in object and in effect aimed at.

SUMMARY OF THE INVENTION

Accordingly, it is an object of the present invention to provide a novel developing method which solves the problems and drawbacks involved in the known developing methods as described above and which enables to obtain high quality developed images with a higher efficiency.

It is another object of the present invention to provide a novel developing apparatus in which a development can be carried out more efficiently in a shorter time and with a high accuracy in comparison with the conventional apparatus.

It is a further object of the present invention to provide a developing method and apparatus for carrying out the same, which allows to use a wide variety of developers without any liYitation of composition of the developer.

Still a further object of the present invention is to provide an improved developing method which enables to prevent developing particles from unnecessarily adhering onto the portion out of the electrostatic latent image portion and thereby allows to obtain developed images free from "fog", and to provide an developing apparatus for carrying out the method.

An even further object of the present invention is to provide an improved developing method which enables to produce developed images free from marginal effect and to provide a developing apparatus for carrying out the same.

To attain the above objects according to the present invention, there is provided a developing method of electrostatic latent images, which comprises a first step of supplying uniformly onto an electrostatic latent image carrying surface a developer containing developing particles ad a second step of supplying to said image carrying surface a liquid so as to remove any excess developer out of the image carrying surface while leaving remained on said surface only such developing particles that are able to be retained as a result of the relative attraction between the electrostatic latent image and the particles to effect developing said latent image.

Also, there is provided a developing apparatus of electrostatic latent images, which comprises a developing particles applying means for making developing particles adhere uniformly onto an electrostatic latent image carrying surface and a liquid supplying means for supplying a liquid to said image carrying surface in such manner that on the image carrying surface there may be left remained only such developing particles that are able to be retained as a result of the relative attraction between the electrostatic latent image and the particles and other excess developing particles may be removed off out of the image carrying surface.

Other and further objects, features and advantages of the invention will appear more fully from the following description.

DESCRIPTION OF THE PREFERRED EMBODIMENTS

Figure 1:
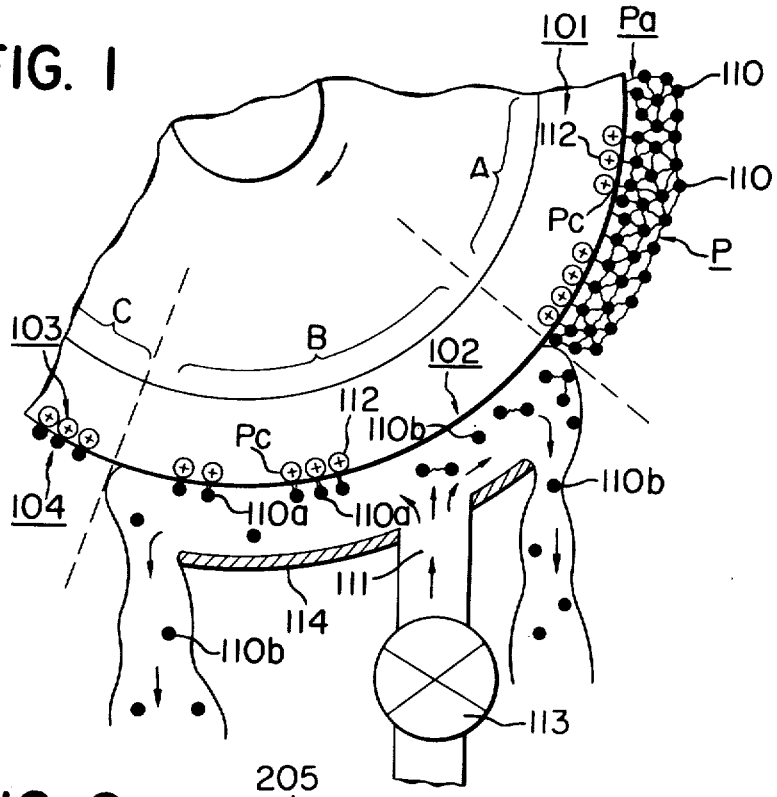
FIG. 1 is a schematic illustration for explaining the principle of the developing method according to the invention.

Before beginning describing the preferred embodiments of the present invention, the technical difference between the method of the present invention and the prior art methods will be described at first to assist in a better understanding of the present invention.

In the conventional developing methods hitherto used, a developer containing pre-charged developing particles is supplied onto an electrostatic latent image carrying surface and almost simultaneously with the supply, the developing particles are adhered selectively only to the latent image portion. Therefore, the development of the electrostatic latent image has almost been completed in this step of the process. For such type of developing method, the charging property of the developing particles and their concentration in the developer have to be adjusted accurately. Otherwise, there may occur incomplete developments or unnecessary ahesion of developing particles onto the non-image portion which will make the developed image unclear.

In contrast with the conventional method as mentioned above, according to the method of the present invention, a developer containing developing particles is at first supplied uniformly onto an electrostatic latent image carrying surface. In this step, the developing particles need not always have electric charge. The developing particles are only required to be held on the image carrying surface. Since the developing particles need not adhere selectively only to the latent image portion, it is allowed to use a developer containing therein developing particles in high concentration. For example, a developer in a form of paint or paste also may be used. At the above mentioned step of the present process, there has not yet taken place any substantial visualization, i.e. development of the latent image. The development takes place at the next step. In the second step, the developing particles existing in the non-image portion where the retentivity of the particles on the image carrying surface is relatively weak compared with those in the image portion, are removed from the image carrying surface, making use of the difference in diffusion ability into a liquid between said two groups of particles. As a result, the latent image is developed at this second step. In order to give the particles a difference in retentivity between the latent image portion and the non-latent image portion, three different measures may be selectively taken. First one is to use in the first step those developing particles which have been electrically charged. Second one is to electrically charge the developing particles before starting the second step. Third measure is to add an electric charge controlling substance into the liquid to be used at the second step. In this manner, at the latent image portion there is produced the action of Coulomb force between the electric charge on the latent image and that on the particle, in addition to an adhesion force as previously described.

In other words, the first step of the developing method of the invention is a step the purpose of which is solely to supply developing particles. Therefore, any developer suitable for the purpose may be used in the invention. For example, it is allowed to use such a developer containing developing particles in far higher concentration than that used in the conventional methods. In the second step, a liquid other than the developer used in the first step is supplied onto the image carrying surface to make use of its diffusing effect on the developing particles. Thus, according to the method of the invention, the development can be carried out efficiently in a far shorter time than that required in the conventional methods. Moreover, the method of the invention enables to eliminate completely marginal effect and fogging.

Also, according to the teaching of the present invention, it is possible to provide a developing apparatus which is sufficiently small in size and uncomplicated in structure enough for practical use.

Now, the invention will be explained in detail showing concrete examples.

The developer used in the invention can be prepared in the following manner:

Any of the resins hitherto widely used as toner for electrophotography may be used as binder. For example, polystyrene, chlorinated paraffin, polyvinyl chloride, phenol resin, epoxy resin, polyester, polyamide, polyacrylic resin, polyethylene, polypropylene and their copolymers may be used alone or in combination.

To the binder, there is added a predetermined amount of coloring matter which may be any of known dyestuff and pigments. Then, the mixture is premixed by a vibrating mill and the resulting powder is melt-kneaded in a roller mill. The kneaded mixture is then roughly pulverized by a hammer mill and further finely pulverized with a jet mill to produce, for example, particles of 1-5 $\mu$ in diameter which are used as dry developing particles. Alternatively, the kneaded mixture is pulverized to produce particles of 0.1-10 $\mu$ in diameter. Then, the particles are dispersed into a suitable liquid in a desired concentration so as to prepare a so-called liquid developer.

According to the invention, the liquid may have a wide selection range. For the conventional liquid developers, the liquid component, i.e. carrier liquid has a severe limitation in respect of electric conductivity and permittivity. Such a limitation is required to secure the deposition ability of the toner. Carrier liquid practically usable for the conventional developing method should have a volume resistance more than $10^{12}\Omega$ cm and a permittivity less than 3. Such a liquid is of course suitable for the method of the invention. But, the present invention allows to use other various kinds of liquid.

Moreover, in the invention there may be used a liquid developer in higher concentration than that used in the conventional method. When a liquid developer is prepared in such manner that particle solid phase and liquid phase are dispersed under a strongly aggregated condition of the solid phase and the liquid phase, then the resulting developer can be applied onto an electrostatic latent image carrying surface employing a well known coating technique such as brush coating, roller coating, spraying and the like.

As a liquid used in the second step of the method according to the invention, there may be used various organic solvents so long as they satisfy the requirements that the volume resistance must be more than $10^{10}\Omega$ cm and the permittivity must be less than 3, and also are capable of dispersing the developing particles used in the first step of the process. Examples of such organic solvent include paraffin hydrocarbon, iso-paraffin hydrocarbon, alicyclic hydrocarbon and halogenated hydrocarbon. More concretely, mention may be made of n-heptane, cyclohexane, dipentene, kerosene, mineral spirit, tetralin, perchloroethylene and trichlorotrifluoroethylene.

Referring now the accompanying drawings, the invention is further concretely described.

FIG. 1 is a schematic illustration showing the principle of the developing method according the invention. In this example shown for the purpose of explanation of the invention, the reference numeral 101 designates an electrostatic latent image carrying body in a form of drum such as a photosensitive body as well-known in the art. The image carrying drum 101 rotates in the direction of arrow. Developing particles are generally designated by 110. In a model like manner, the drawing of FIG. 1 shows three different phases of the process in areas A, B and C, respectively. In the first phase shown in area A, the developing particles 110 adhere uniformly onto the surface of the image carrying drum 101. In the second phase of area B, a liquid 111 is supplied onto the surface of the drum 101, which liquid may contain or not contain developing particles. Those developing particles 110 which are attracted by electrostatic charges 112 are left remained on the image carrying surface 102. These developing particles are generally designated by **110*a*. The electrostatic charge 112 is shown as a positive electric charge only for the sake of illustration, but it may be a negative charge. Other excess developing particles 110*b* separate from the surface 102 and diffuse into the liquid 111. In area C there is shown the third phase in which an electrostatic latent image 103 is visualized, i.e. developed with the developing particles 110**.

Between the individual particles 110 present in area A there exists a cohesive power P indicated by wave line and also between the latent image carrying body 101 and the developing particles 110 there exists an adhesive power Pa indicated by broken line. Owing to these powers, the developing particles 110 in area A adhere substantially uniformly onto the latent image carrying body 101. It is obviously seen that in this area of A there has not yet taken place any development.

The image carrying drum 101 is rotated in the direction of arrow from area A to area B. In the area B, the liquid 111 pumped by a pump 113 is jetting against the electrostatic latent image carrying surface 102 and flowing along the surface with its liquid stream being restricted by a dish 114. The liquid 111 contains no developing particle 110 or, if contains, its concentration in the liquid is very low. Therefore, in such a liquid, the distance between individual particles becomes too large for the cohesive power to act upon the particles and rather the particles have the tendency to diffuse in the liquid. Moreover, the stream of the liquid has a sweeping action. Accordingly there is produced a synergetic effect and as a result the developing particles **110*b* having a relatively weak adhesive power on the surface 102 spread over into the liquid 111** and are rapidly dissipated.

On the other hand, the developing particles **110*a* adhered to the portion where an latent image has been formed, namely to the electrostatic charge 112, resist against the diffusing force of the liquid 111 and can be retained on the surface. More particularly, while the particles 110*a* are also released from the cohesive power by the diffusing action of the liquid 111 and subjected to a diffusing force of the liquid, but at the same time there acts a Coulomb force between the electric charge given to the particle itself and the electric charge of the latent image, which enables the particle to resist against the diffusing force of the liquid. In the drawing of FIG. 1**, such Coulomb force is indicated by Pc.

The above described effect depends upon the quantity of electric charge on the latent image. Thus, at the portion where the potential of the latent image is high, there are left retained developing particles and at the portion of no latent image potential, there is remained no developing particle. In this manner, after subjected to the action of the liquid 111, the developing particles can produce a developed image 104 faithful to the latent image (area C).

It is by no means so difficult to carry out the developing method of the invention based on the above described principle. For example, the development of an electrostatic latent image can be effected by applying at the first step to an image carrying surface developing particles in some 3–30 times higher concentration than that for the conventional liquid developer and at the next step supplying a suitable organic solvent which, for example, corresponds to one of the known carrier liquids previously described.

As already described, in the conventional methods, the supply of developing particles onto the electrostatic latent image carrying surface and the development of the latent image depend upon the migration and deposition of the particles in the carrier liquid which in turn depend upon the phenomenon of electrophoresis of the electrically charged particles in an electric field formed by the electrostatic latent image. Therefore, in order to obtain a developed image of high density, a higher electric field and charging of developing particles with a higher electric charge are required. The level of the electric field and the electric charge must be sufficiently high enough to attain such speed of electrophoresis that assures the required migration and deposition of the developing particles. This requires in turn to produce an electrostatic latent image of high potential and also to strengthen the electric field employing a suitable opposite electrode.

However, a production of latent image having a high surface potential is a difficult task as a general rule. Also, as for the production of a high electric field, there are many limitations. It is also well-known that the preparation of developing particles with a high electric charge is difficult. These difficulties are further enhanced when man trys to carry out a development in a high speed according to the conventional method. For these reasons, it was a common knowledge in the art that usually a high speed development with a liquid developer is extremely difficult.

According to the invention, however, the supply of developing particles to the electrostatic latent image and the development of the latter are carried out independently of each other and thereby the above described difficulties can be overcome completely. Namely, the method of the invention makes it possible to use a developer containing therein developing particles in high concentration which allows to supply the developing particles to the electrostatic latent image carrying surface depending solely upon the adhesive power of the particles per se. Since the supply is effected making use of the adhesive power only, there is no need of time for the electrophoresis of particles. The amount of developer required becomes far smaller than that required for the conventional method. Thus, a high speed supply of developer and therefore a high speed development bcome possible.

Another advantage of the method of the invention is found in that the visualization, i.e. development of an electrostatic latent image is effected depending upon an electrostatic adhesive power of the developing particles adhered onto the image. In other word, the development is effected making use of a Coulomb force acting on the particles in the position close to the electric charge of the electrostatic latent image. In the conventional method, the principle of development is based upon the electrophoresis action of developing particles depending upon an electric field formed by the electric charge of the electrostatic latent image. Compared with such conventional method, the method of the invention does not require any electrostatic latent image of high electric charge. The quantity of electric charge which an electrostatic latent image has to have can be reduced up to an extremely low level. Even when the surface potential on the photosensitive body is low, it is also possible to obtain a developed image of high density sufficient enough for practical purpose.

In addition to the above described advantages of the method according to the invention, the following further advantages and merits are obtainable from the invention in comparison with the conventional methods:

1. A so-called "background fogging" can be prevented completely. This is because the developing particles in the non-latent image portion are dissipated into the liquid simultaneously with the developing step, making use of the diffusing effect of the liquid.

2. Since there is not used any electrophoresis phenomenon of particles, no trouble of marginal effect is caused.

3. Since the developing particles on the image carrying surface have almost no irregularity in density, there can be produced a high quality developed image without any irregularity of development.

4. In the conventional method, change in concentration of the developing particles in the liquid used at the developing step considerably affects the effect of deposition of the particles. But, such a change hardly affects the diffusing effect of particles which is made use of according to the invention. As a result, according to the method of the invention, there can be produced good quality developed images in a stable manner without the result of development being adversely affected by any possible change in concentration of the developing particles in the liquid used in developing step.

By way of example, the latent image portion is shown in FIG. 1 to have positive charge. This is made solely for illustration. The electric charge may be, of course, negative. Rather, the developing method of the invention is also applicable to the case where positive and negative charges coexist on an image carrying surface, for example, with its latent image portion being positively charged whereas the non-latent image portion is negatively charged or vice versa.

Figure 2:
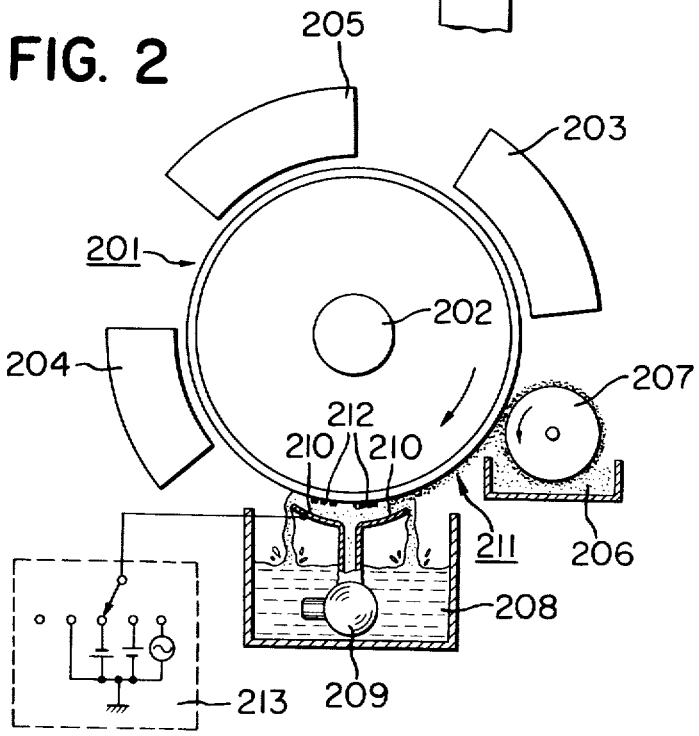
FIGS. 2 through 9 are schematic sectional views of image forming apparatus showing various embodiments of the invention respectively wherein the present invention is applied to an electrophotographic copying machine.

FIG. 2 illustrates an embodiment of the present invention wherein the method of the invention is applied to an image forming apparatus practically in use. By way of example, an electrophotographic copying machine well-known in the art is shown as the image forming apparatus.

A photosensitive drum 201 rotates in the direction of arrow around its shaft 202. Around the circumference of the drum, there are disposed a latent image forming station 203, a transferring station 204 where a developed image is transferred onto a transferring material, and a cleaning station 205 where after transferring, the remaining developer is cleaned off and if necessary the latent image once formed is erased. Reference numeral 206 designates a liquid developer containing electrically charged developing particles in a high concentration. A developer supplying roller 207 is supported for rotation in the direction indicated by the arrow through a driving power source. The roller is so disposed that its surface is close to the surface of the photosensitive drum 201 and a portion of the roller is always immersed in the bath of developer 206 to receive it. In this manner, the developer 206 is supplied to the surface of the photosensitive drum 201 through the supplying roller 207. Reference numeral 208 designates a liquid which contains developing particles in a low concentration or does not contain the particles at all. he liquid 208 is injected in a form of jet against the surface of the photosensitive drum 201 by a pump 209. A dish 210 is provided to receive the liquid and guide the flow of the liquid along the drum surface. Individual developing particles contained in the developer 206 in a high concentration are indicated by dark point in the drawing. These particles have a high adhesive power and a high interparticle cohesive power sufficient enough to adhere uniformly onto the photosensitive drum 201. This phase of the developing particles is shown in the area designated by 211. As the drum rotates, the area 211 is moved into the next area where the liquid 208 is applied. In the area, the liquid stream of the liquid 208 has an effect to diffuse the particles into it and sweep the particles from the drum surface. As a result, while the particles 212 adhered onto the latent image can be retained, other developing particles are rapidly dissipated into the liquid.

Reference numeral 213 designates an electric power source part that is used to give the particles a suitable potential and thereby to electrophysically accelerate their adhesion to the surface of the photosensitive drum 201. For example, a suitable voltage is applied to the photosensitive drum 201 and the liquid receiving dish 210 in accordance with the characteristics of the latent image on the drum and of the liquid developer 206. Also, considering the above characteristics, floating for acquiring an induced voltage or grounding may be used for this purpose.

In this embodiment, a roller is shown as one example of developer supplying or applying means. But, it is to be understood that within the scope of the invention other various known means may be used in stead of the roller. For example, brush coating, dropping through a nozzle or an endless belt may be used.

Figure 3:
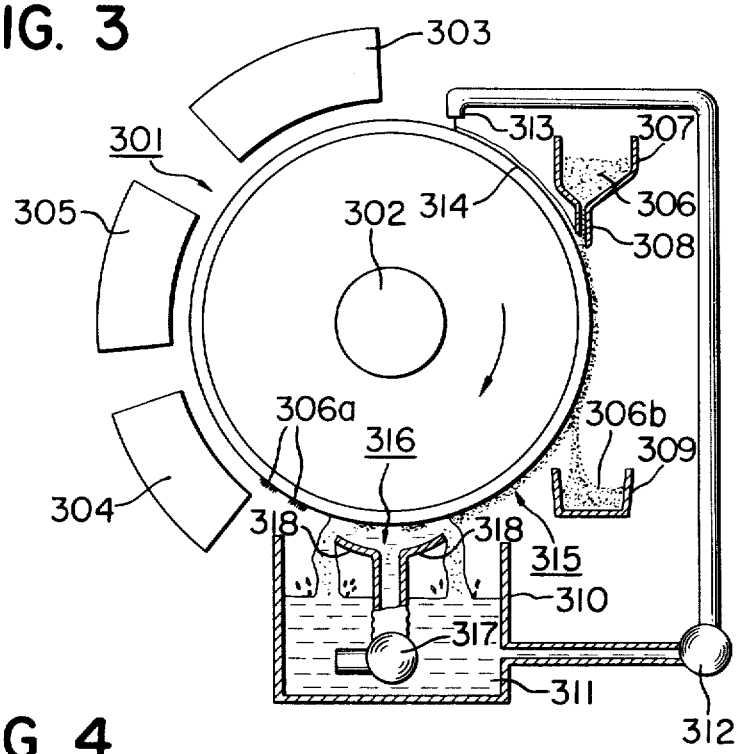

FIG. 3 illustrates another embodiment of the invention. The basic arrangement of the apparatus is similar to that of FIG. 2. The reference numeral 301 designates again a photosensitive body in a form of drum which rotates around its shaft 302 in the direction of the arrow. The reference numeral 303 designates a latent image forming station, 304 is a transferring station and 305 is a cleaning station. In this embodiment, there is used not a liquid developer but a dry developer generally designated by 306. The dry developer 306 is electrically charged with an electric charge of opposite polarity to that of the electric charge of latent image. The developer is supplied to the surface of the photosensitive drum 301 from a developer container 307 through a guide 308. Such excess developer that does not adhere onto the drum 301, that is, the developer **306*b* is recovered into a dish like receptacle 309. A pump 312 pumps up a liquid 311 from a liquid reservoir 310. The liquid 311 thus pumped is dropped onto the surface of the drum 301 through a nozzle 313 so as to form a liquid film 314 which serves to accelerate the adhesion of the developer 306 on the drum surface. In this manner, developing particles (indicated by dark point) of the developer 306 adhere uniformly onto the surface of the photosensitive drum 301. This phase of the developer is shown in the area indicated by 315. As the drum rotates, the area 315 is moved into an area indicated by 316. In this liquid supplying area 316, the drum surface having the developing particles adhered thereon comes into contact with the stream of a liquid 311 pumped up by a pump 317 and guided by a liquid receiving dish 318. The liquid 311 preferably used is such an organic solvent that is relatively low in viscosity and easy to volatilize even when it is brought out on a transferring material at the transferring station 304. As previously described, the liquid 311 in this area 316 has an effect to diffuse the developing particles adhered on the drum surface into the liquid. Therefore, only those developing particles are left remained on the surface which are able to be retained against the diffusing action of the liquid, due to Coulomb force between the electric charge of the developing particle and the electric charge of the latent image the polarity of which is opposite to that of the particle, and other excess developing particles are dissipated into the liquid 311. According to the embodiment, there are produced good developed images 306*a* faithful to the latent image and free from any adverse effects of fogging and/or marginal effect. In this embodiment, when as the liquid 311, a liquid is used which is capable of swelling the developing particle to a suitable extent, then the particle can acquire a self-fixing property. Thus, the developed image 306*a*** becomes automatically a fixed image when the liquid contained in the developed image evaporates.

Figure 4:
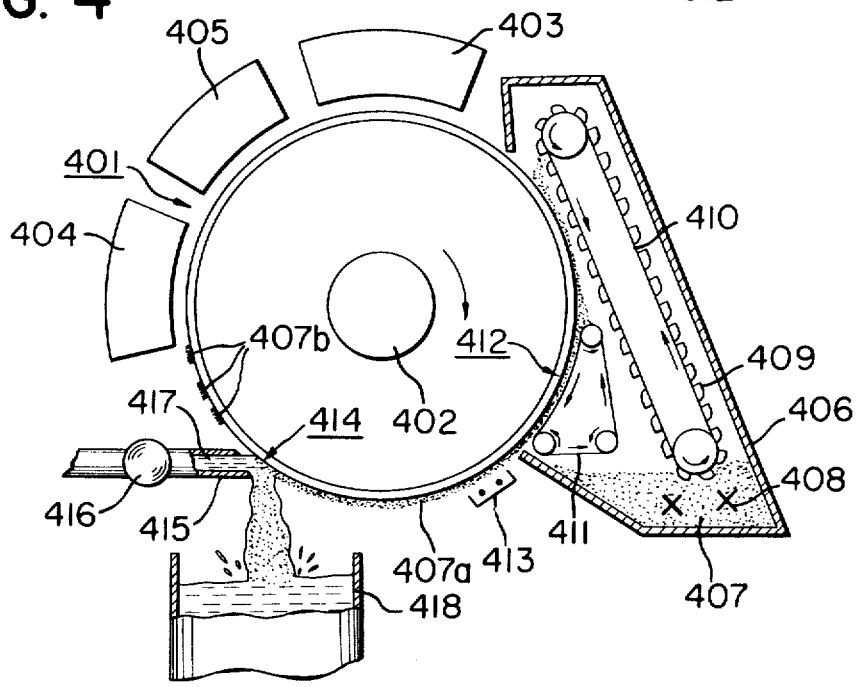

Referring to FIG. 4 showing a further embodiment of the invention similar to that of FIG. 3, the reference numeral 401 designates again a photosensitive body in a form of drum which rotates in the direction of the arrow around its shaft 402. An electrostatic latent image forming station is designated by 403, a transferring station by 404 and a cleaning station by 405. These stations have the same functions as those described previously for the first embodiment of FIG. 2, respectively. Within a developer reservoir 406, there is an amount of dry developer 407 containing developing particles. The dry developer in the reservoir is continuously stirred in a suitable manner as suggested by 408 and transported onto the surface of the drum 401 by an endless belt 410. For this purpose, the endless belt is provided with a plurality of small buckets 409 in a manner of bucket conveyor and rotates in the direction of the arrow. Spaced slightly from the circumference of the photosensitive body 401, there rotates a belt-like member 411 in the direction of the arrow and at a speed approximately equal to the peripheral speed of the photosensitive drum 401. When the developer 407 is moving through the space area 412 between the drum surface and the surface of the belt-like member 411, it adheres onto the photosensitive drum 401. Preferably the developer 407 has an electric charge of the opposite polarity to that of the charge of the latent image. The reference numeral 413 designates a corona charging device which is used to apply an electric charge to the developer **407*a* adhered on the photosensitive drum 401**. This charging assures an effective development at the next step of the process.

In the area indicated by 414, there is provided a nozzle 415 close to the drum 401. From the opening of the nozzle, a liquid 417 is injected by means of a pump 416. Now, the developer adhered to the drum surface is subject to the diffusing action of the liquid as previously described. As a result, only the developer **407*b* is left retained on the drum surface owing to the Coulomb force acting between the electric charge thereof and the electric charge of the latent image whose polarity is opposite to that of the developer, and other part of the developer 407*a* is dissipated into the liquid 417**.

418 designates a recovering vessel for the liquid 417. The recovering vessel 418 may be so designed as to circulate the recovered liquid to the area 414 for reuse (not shown).

Figure 5:
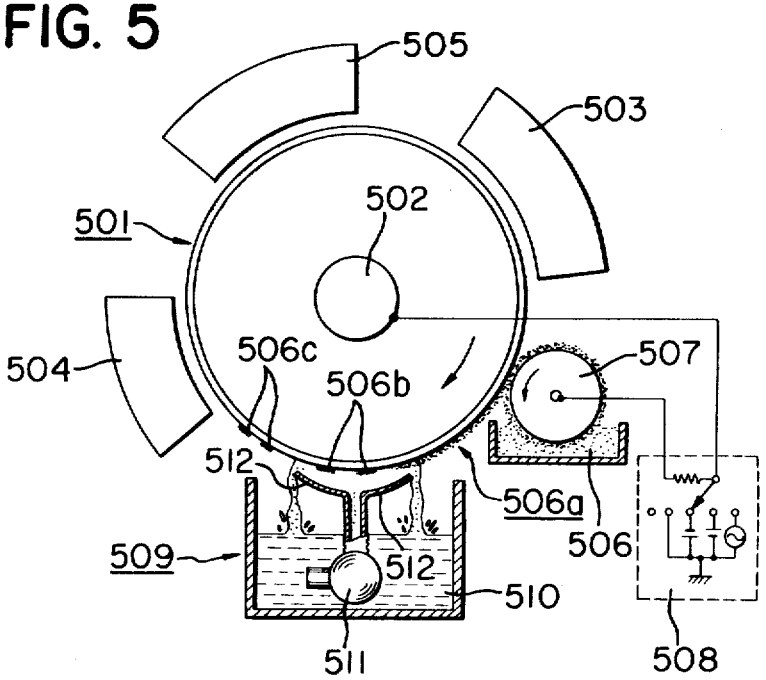

FIG. 5 illustrates still a further embodiment which may be considered as a modification of the embodiment of FIG. 4. The reference numeral 501 designates again a photosensitive body in a form of drum which rotates in the direction of the arrow around its shaft 502. An electrostatic latent image forming station 503, a transferring station 504 and a cleaning station 505 have the same function respectively as that of the corresponding part in the above described embodiments. A roller 507 supplies developing particles 506 to the surface of the photosensitive drum 501. The reference numeral 508 designates an electric power source part which is used to accelerate the supply of the developing particles 506 to the surface of the drum 501 and their adhesion on the latter in a suitable manner as previously described referring to the drawing of FIG. 2. As the drum 501 rotates, the developing particles **506*a* uniformly adhered to the surface of the drum is moved into the liquid supplying part 509. In this part, a liquid 510 that contains in a low concentration or does not contain at all developing particles is jetted out against the drum surface by a pump 511. A liquid receiving dish 512 guides the liquid stream along the surface of the photosensitive drum 501. The stream of the liquid 510 drives the developing particles on the drum surface in dissipating into the liquid by the diffusing and sweeping action thereof except the developing particles 506b remained adhered to the latent image portion. Thus, there is produced a developed image 506c** faithful to the latent image.

Figure 6:
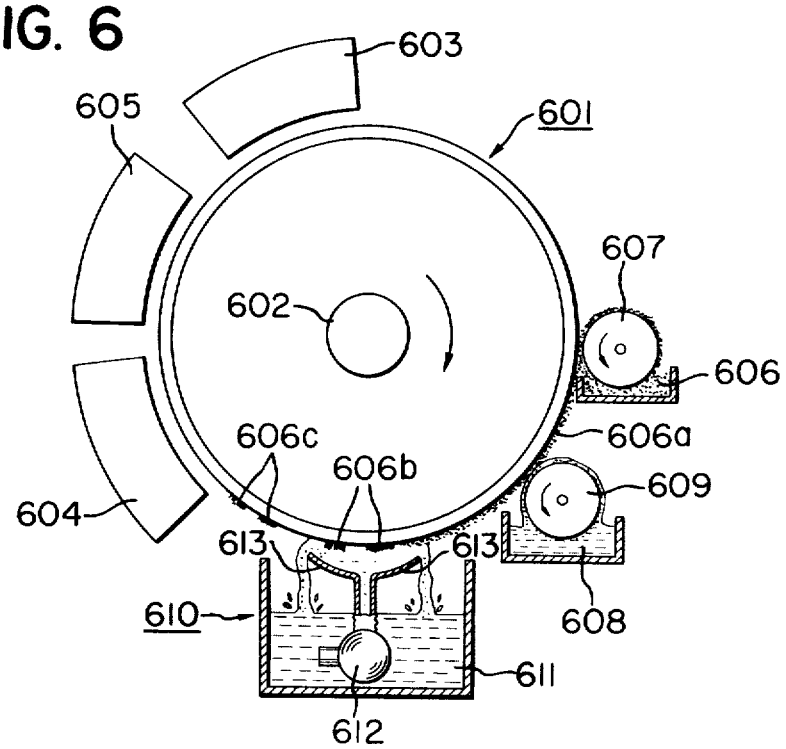

A further embodiment of the invention is shown in FIG. 6 which is a schematic view of an image forming apparatus using a liquid developer containing developing particles in a high concentration. The developing particles have no electric charge preliminarily charged. If the particles have any electric charge, it is extremly weak. Again, 601 designates a photosensitive body in a form of drum which rotates in the direction of arrow around its shaft 602. Around the photosensitive drum 601, there are arranged an electrostatic latent image forming station 603, a transferring station 604 and a cleaning station 605 just like the embodiments previously described. Reference numeral 606 designates a liquid developer containing in a high concentration developing particles having almost no electric charge. A developer supplying roller 607 is supported for rotation in the direction of arrow by the driving power from a driving source not shown. The liquid supplying roller 607 is so disposed that its surface comes close to the surface of the photosensitive body 601 and a portion of the roller is immersed in the liquid developer 606 for receiving it. In this manner, the developer 606 is supplied to the surface of the drum 606 through the roller 607. Reference numeral 608 designates a solution containing a known charge controlling substance. The solution is coated onto the developer 606a adhered to the surface of the photosensitive drum 601 by means of an applicator roller 609 that rotates in the direction of arrow keeping a small gap between its surface and the drum surface. After the solution 608 is applied onto the developer 606a, the individual developing particles have an electric charge owing to the effect of the charge controlling substance. But, there occurs no migration of the particles because of the strong cohesive power acting there-between. Now, the developer 606a containing developing particles uniformly adhered on the drum surface is moved into the liquid supplying part 610. In this area, a liquid 611 that contains developing particles in a low concentration or does not contain at all is forced out against the surface of the photosensitive drum 601 by a pump 612. A liquid receiving dish 613 controls the flow of the liquid so as to form a stream of the liquid 611 flowing along the surface of the drum 601. While the developing particles 606b adhered to the latent image portion can remain on the drum surface, other particles are rapidly dissipated into the liquid by the diffusing and sweeping action thereof. Thus, there is produced a developed image 606c faithful to the latent image.

In this embodiment, the charge controlling substance is shown to be applied by a roller. However, as an alternative, the charge controlling substance may be preliminarily incorporated into the liquid 611.

Figure 7:
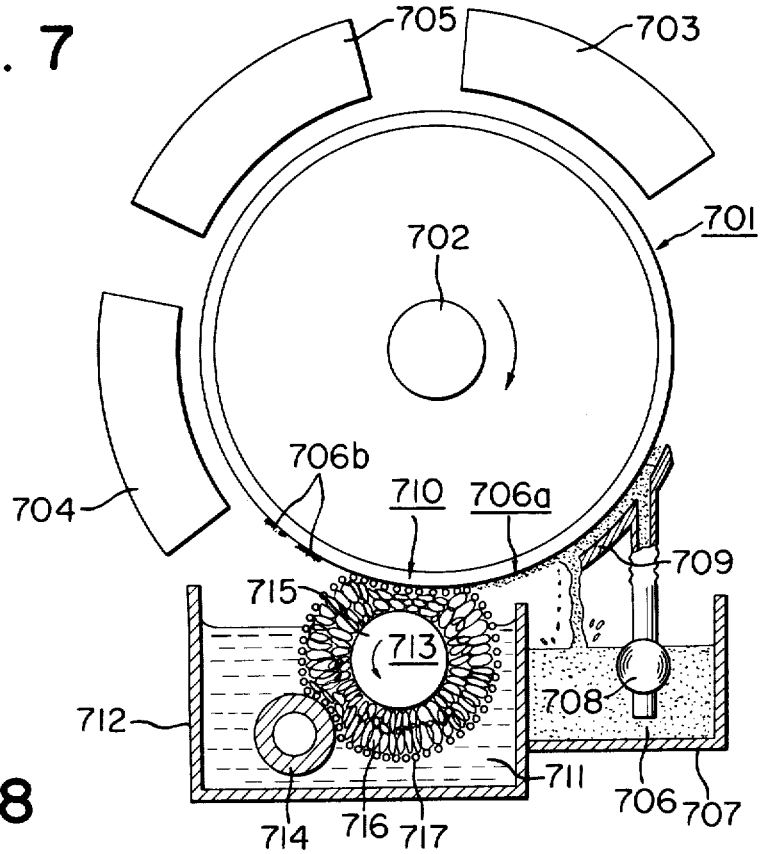

FIG. 7 illustrates an even further embodiment of the invention. In this embodiment, a jet flow of a liquid developer is used at the step of adhesion of developer which contains developing particles in a high concentration, and at the step of developing, there is used a roller composed of flexible members. Like in other embodiments, the present invention is embodied in a known electrophotographic copying machine shown as an example of image forming apparatus.

The arrangement of a rotary photosensitive body 701 with a shaft 702 in a form of drum, an electrostatic latent image forming station 703, a transferring station 704 and a cleaning station 705 is the same as that in other embodiments previously described. Reference numeral 706 designates a liquid developer containing developing particles in a high concentration. 707 is a reservoir for the liquid developer 706, 708 is a pump for supplying the liquid developer to the surface of the photosensitive drum 701 and 709 is a liquid developer receiving dish for controlling the stream of the liquid developer. In this area, the liquid developer supplied to the drum surface adheres uniformly thereon (see 706a). As the drum rotates in the direction of arrow, the drum surface having the liquid developer adhered thereon is moved into the developing area indicated by 710. In this area 710, there are provided a liquid vessel 712 for a liquid 711 which contains developing particles in a low concentration or does not contain at all, a flexible roller 713 and a squeezing roller 714 in contact with the flexible roller 713 under pressure. The flexible roller is so disposed that a portion of the roller may be immersed in the liquid 711 contained in the liquid vessel 712. The flexible roller is composed of a core roller 715, an elastic foam member 716 made of, for example, a polyurethane foam, and a net 717 of, for example, wire or plastics enclosing the foam member 716 in a manner of endless covering.

The core roller 715 of the flexible roller 713 is supported in such manner that by a driving power from a driving power source (not shown), the net 717 at its contacting portion with the photosensitive drum 701 may be rotated in the same direction and also at the almost same speed as that of the drum. In the liquid 711, the flexible roller 713 is in press-contact with the squeezing roller 714 which effects exchanging the liquid 711 contained in the foam member 716. It is possible to make all of the foam member 716, the net 717 and the squeezing roller 714 from electrically conductive materials. In particular, it is preferable to make at least one of the foam member 716 and the net 717 from an electrically conductive material. By doing so, there can be obtained a better developed image free from any marginal effect. When the flexible roller 713 comes in contact with the photosensitive drum 701, a portion of the liquid 711 contained in the foam member 716 is squeezed out onto the surface of the drum. Now, the developer 706a is subjected to a diffusing action of the liquid. As a result, the developing particles are dissipated into the liquid except such particles that adhered to the latent image portion. In this stage of developing, the flexible roller 713 has a particularly advantageous effect on the development. Since the roller has an elasticity, it can form a surface-contacted nip with a width normal to the direction of its rotation axis. This nip serves as a wide and uniform effective width for developing. Thereby it is allowed to produce developed images of good quality without any irregularity or omission.

This embodiment brings forth other various advantages. The impact of the liquid 711 against the photosensitive body 701 is small and the flow of the liquid along the direction of the nip is negligibly small. Therefore, any otherwise possible distortion of latent image, developed image or the like is prevented. Furthermore, immediately after released from the contact pressure with the photosensitive drum 701, the foam member 716 restores its original state from the state deformed by compression. At this time point, the quantity of liquid contained in the foam member is relatively small and therefore it restores a liquid absorbing power to a suitable extent. The absorbing power effects a very efficient removal of the excess developing particles existing on the photosensitive drum. At the same time, any unnecessary liquid is removed by it. Thus, immediately after developing, carrier liquid which is apt to remain on the drum surface after development as an unnecessary component of the liquid developer, the excess developing particles and/or the liquid 711 are absorbed into the foam 716 through the net 717 owing to the combined effect of the above described absorbing power and the large surface area and surface tension of the flexible roller 713.

In this manner, on the photosensitive body 701 there are remained only those developing particles 706*b* which adhered to the portion substantially corresponding to the latent image. The developing particles 706*b* thus remained on the photosensitive drum 701 are then moved into the transferring station 704.

Figure 8:
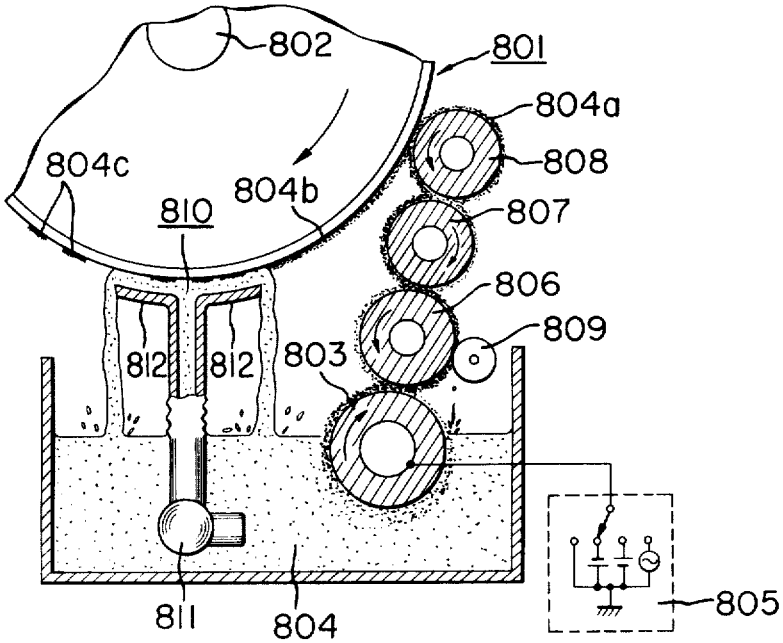

FIG. 8 is a partial and schematic cross-sectional view of an image forming apparatus in which same liquid developer is used for both the two steps of the process according to the invention. In this drawing of FIG. 8 showing a further embodiment of the invention, the reference numeral 801 designates again a photosensitive body in a form of drum which rotates in the direction of arrow around a shaft 802. While not shown in the drawing, there are arranged an electrostatic latent image forming station, a transferring station and a cleaning station around the photosensitive drum 801. Only the station shown in the drawing is a developing station. Reference numeral 803 designates a scoop roller for scooping a liquid developer 804. When it is necessary, an AC or DC bias voltage is applied to the scoop roller 803 by an electric power source part 805. The roller is driven through a driving source (not shown) to rotate in the direction of arrow. The roller 803 is so positioned that at least a portion of the roller is dipped into the developer 804 for in particular selectively collecting the developing particles contained in the developer and transporting the particles up to a developer coating roller 808 through intermediate rollers 806 and 807. The rollers 806 and 807 are positioned close to each other and the roller 806 is also close to or in contact with the scooping roller 803 whereas the roller 807 is close to or in contact with the coating roller 808. Thus, the intermediate rollers 806 and 807 effect conveying and mixing of developer and controlling of liquid content in the developer. During the developer 804 being conveyed by the rollers 803, 806, 807 and 808 successively in this order, the developer is continuously mixed, kneaded and thickened so that onto the coating roller 808 there may be supplied such developer in which developing particles are uniformly distributed in a high concentration, which is indicated by 804*a* in the drawing. Near close to the intermediate roller 806, there is provided a liquid squeezing roller 809 that is supported for rotation of the direction same as or opposite to that of the immediate roller 806 by a driving system (not shown). The liquid squeezing roller 809 controls the liquid content in the developer on the intermediate roller 806. The coating roller 808 applies the highly thickened developer 804*a* to the surface of the photosensitive drum 801 uniformly. To this end, it is disposed close to or in contact with the drum surface for rotation in the direction of arrow by a driving system (not shown). In this manner, a developer 804*b* that contains developing particles in a high concentration uniformly adheres onto the photosensitive body 801 and is moved into the developing area 810 as the drum rotates.

In the developing area 810, a liquid developer containing developing particles in a relatively low concentration, that is, the developer 804 is forced out against the surface of the photosensitive body 801 by a pump 811. The stream of the liquid developer is guided by a receiving dish 812 so as to flow along the drum surface. By the diffusing and sweeping action of the liquid stream, excess developing particles are rapidly dissipated into the liquid while leaving remained on the photosensitive drum surface only those developing particles that adhered to the latent image portion. Thus, there is produced a developed image 804*c* faithful to the latent image. Of course, in this embodiment it is possible to replace the liquid supplying means shown in the developing area by a flexible roller as illustrated in FIG. 7.

Figure 9:
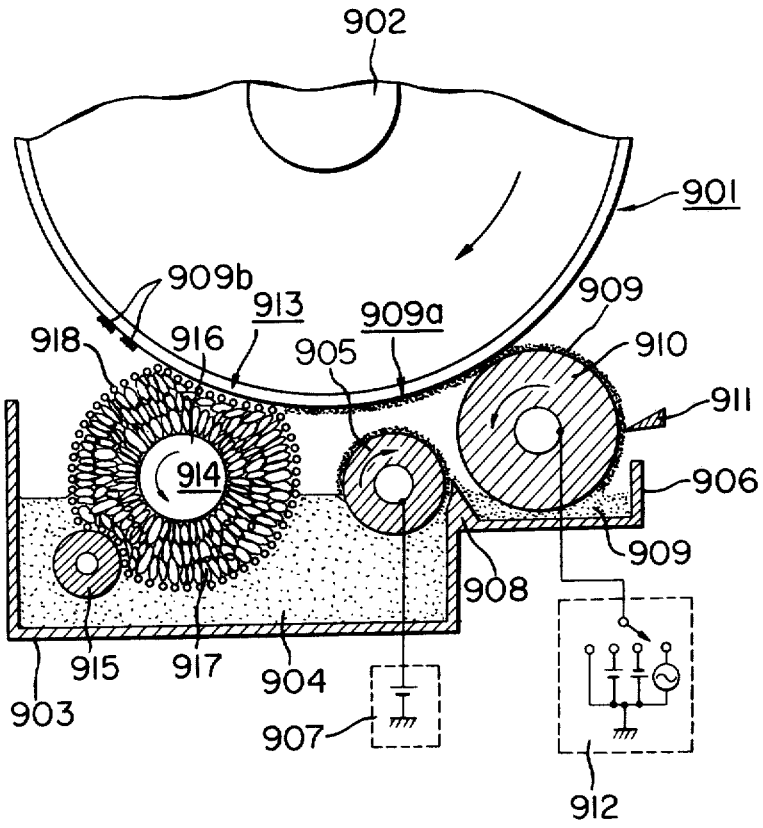

FIG. 9 shows still a further embodiment of the invention. The essential feature of the embodiment of FIG. 9 resides in that from the liquid used in developing step, developing particles are recovered so as to reuse in developer applying step.

The reference numeral 901 designates again a photosensitive body in a form of drum which rotates in the direction of arrow around a shaft 902. As shown and described previously, during a rotation of the drum 901 it passes through succesively an electrostatic latent image forming station, a developing station, a transferring station and a cleaning station, of which only the developing station is shown in FIG. 9 for the purpose of clarification of illustration.

A liquid reservoir 903 contains a liquid 904 which contains developing particles in a low concentration. The developing particles contained in the liquid 904 are selectively recovered by a scooping roller 905 and then, in a thickened state, scraped into a developer container 906 by a blade 905. To carry out the above described selective recovering efficiently, a voltage is applied to the scooping roller 905 from an electric power source part 907. For example, when the developing particle has a negative electric charge, then a positive voltage is applied to the scooping roller.

The reference numeral 909 designates a developer containing developing particles in a high concentration which is carried by a developer applying roller 910 and coated onto the surface of the photosensitive drum 901 uniformly as to form a layer 909*a*. A guide 911 regulates the amount of developer to be applied.

The reference numeral 912 designates an electric power source part which is used to electrophysically accelerate the adhesion of the developer 909 to the surface of the photosensitive body 901 by applying a most appropriate potential to the roller in a suitable manner as particularly described before referring to FIG. 2.

The surface of the photosensitive drum 901 having the developer 909*a* uniformly adhered thereon is moved into the developing area designated by 913 as the drum rotates. In this area 913, here are provided a liquid vessel 903 for the liquid 904 containing developing particles in a low concentration, a flexible roller 914 and a squeezing roller 915 in press-contact with the flexible roller. The flexible roller 914 is so disposed that a portion of the roller may be dipped in the liquid 904 in the liquid vessel 903. The flexible roller is composed of a core roller 915, an elastic foam member 917 made of, for example, a polyurethane foam, and a net 918 of, for example, wire or plastics enclosing the foam member 917 in a manner of endless covering.

The core roller 916 of the flexible roller 914 is supported in such manner that by a driving power from a driving source (not shown) the net 918 at its contacting portion with the photosensitive drum 901 may be rotated in the same direction and also at the almost same speed as that of drum 901. In the liquid 904, the flexible roller 914 is in press-contact with the squeezing roller 915 which effects exchanging of the liquid 904 and developing particles contained in the foam member 917. It is possible to make all of the foam member 917, the squeezing roller 915 and the net 918 from electrically conductive materials. In particular, it is preferable to make at least one of the foam member and the net from an electrically conductive material. By doing so, there can be obtained a better developed image free from any marginal effect. When the flexible roller 914 comes into contact with the photosensitive drum 901, a portion of the liquid 904 contained in the foam member 917 is squeezed out onto the surface of the drum. Now, the developer 909*a* is subjected to the diffusing action of liquid. As a result, all of excess developing particles are dissipated into the liquid 904 while leaving remained on the drum surface only those developing particles that adhered to the latent image portion.

In the above stage of developing, the flexible roller 914 has a particularly advantageous effect on the development. Since the roller has an elasticity, it can come in contact with the photosensitive drum in a manner of surface-to-surface contact and form a wide nip therebetween with a width normal to the direction of its rotation axis. This nip serves as a wide and uniform effective width for developing. Thereby, it is allowed to produce developed images of good quality without any irregularity and/or omission.

The following other various advantages are obtainable from this embodiment:

The impact of the liquid 904 against the surface of the photosensitive body 901 is small and further the flow of the liquid along the direction of the nip is negligibly small. Therefore, any otherwise possible distortion of latent image, developed image or the like is prevented.

The foam member 917 restores its original state from the deformed state caused by the contact pressure with the photosensitive drum 901 immediately after the member is released from the pressure. At this time point, the quantity of liquid retained in the foam member 917 is relatively small and therefore the member restores a liquid absorbing power to a suitable extent. This absorbing power results in a very efficient removal of the excess developing particles existing on the photosensitive drum. At the same time, unnecessary liquid is removed by it. Thus, immediately after developing, carrier liquid which is apt to remain on the drum surface after developing as an unnecessary component of the liquid developer, and excess developing particles are absorbed into the foam member 917 through the net 918 owing to the combined effect of the above described absorbing power and the large surface area and surface tension of the flexible roller 914.

In this manner, on the photosensitive body 901, there are remained only those developing particles that adhered onto the latent image portion. These developing particles indicated by 909*b* are then moved into the transferring station.

While the invention has been particularly shown and described with reference to preferred embodiments thereof, it will be understood by those skilled in the art that the foregoing and other changes in form and details can be made therein without departing from the spirit and scope of the invention.

Also, as to the latent image carrying member, it is never limited only to a photosensitive body in a form of drum as shown and described in the above embodiments. An electrostatic recording material or other member capable of carrying electrostatic latent images may be used in the invention. The image carrying member may be of any suitable form such as drum, sheet or web.

We claim:

1. A method for developing electrostatic latent images which comprises a first step of coating uniformly to an electrostatic latent image carrying surface with a developer containing developing particles to adhere the developing particles all over the surface and a second step of applying a liquid to said surface to remove the physical adhesive force of the developer so that mainly the electrostatic force of the developer is effective so that any excess developer from the surface is removed while only those developing particles which are able to be retained as a result of the relative attraction between said particles and said electrostatic latent image remain on the surface so as to visualize said latent image.

2. A developing method as claimed in claim 1, wherein said developer used in the first step comprises developing particles and a carrier liquid therefor.

3. A developing method as claimed in claim 2, wherein said developer contains developing particles as its major part in volume.

4. A developing method as claimed in claim 1, wherein said developer used in the first step consists of dry developing particles only.

5. A developing method as claimed in claim 1, which comprises the further step of applying to said developing particles an electric charge simultaneously with or subsequent to the first step.

6. A developing method as claimed in claim 1, wherein said developing particles have no preliminarily electric charge.

7. A developing method as claimed in claim 1, wherein said developing particles have a preliminarily electric charge.

8. A developing method as claimed in claim 5, wherein said developing particles have no preliminarily electric charge.

9. A developing method as claimed in claim 5, wherein said developing particles have a preliminarily electric charge.

10. A developing method as claimed in claim 1, wherein said liquid contains a charge controlling substance for developing particles.

11. A developing method as claimed in claim 1, wherein at the second step, said electrostatic latent image carrying surface is subjected to the action of an electric field.

* * * * *